US012716234B2

(12) United States Patent
Khatri et al.

(10) Patent No.: US 12,716,234 B2
(45) Date of Patent: Aug. 25, 2026

(54) SUSPENDED CEILING SYSTEM AND METHOD

(71) Applicant: Saudi Arabian Oil Company, Dhahran (SA)

(72) Inventors: Waseem Ahmad Khatri, Dhahran (SA); Mazin Mohammednour Menkabo, Al Khobar (SA); Oscar Daniel Salazar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 155 days.

(21) Appl. No.: 18/611,212

(22) Filed: Mar. 20, 2024

(65) Prior Publication Data

US 2025/0297476 A1 Sep. 25, 2025

(51) Int. Cl.

| | |
|---|---|
| ***E04B 9/22*** | (2006.01) |
| ***E04B 9/04*** | (2006.01) |
| ***E04B 9/06*** | (2006.01) |
| ***E04B 9/30*** | (2006.01) |

(52) U.S. Cl.

CPC ..... *E04B 9/225* (2013.01); *E04B 9/0435* (2013.01); *E04B 9/065* (2013.01); *E04B 9/067* (2013.01); *E04B 9/30* (2013.01)

(58) Field of Classification Search

CPC ..... E04B 9/225

See application file for complete search history.

(56) References Cited

U.S. PATENT DOCUMENTS

| | | | | |
|---|---|---|---|---|
| 7,503,147 | B2 | 3/2009 | Foss | |
| 7,765,761 | B2 | 8/2010 | Paradis | |
| 8,028,791 | B2 * | 10/2011 | Kliegle | E04B 9/001 52/22 |

(Continued)

FOREIGN PATENT DOCUMENTS

| | | | |
|---|---|---|---|
| EP | 2884019 B1 * | 11/2016 | E04B 9/225 |
| FR | 2524521 A * | 10/1983 | |

OTHER PUBLICATIONS keelmfg.com [online], "Installation Guide for Keelgrid," Report #5376, available on or before May 17, 2005, via Internet Archive: Wayback Machine URL <https://web.archive.org/web/20050517020439/https://www.keelmfg.com/files/Keel_Install_Guide.pdf>, retrieved on Sep. 4, 2024, 8 pages.

(Continued)

*Primary Examiner* — Brian D Mattei
(74) *Attorney, Agent, or Firm* — Fish & Richardson P.C.

(57) ABSTRACT

A ceiling system configured such that when a runner of a first panel assembly and a runner of a second panel assembly are each slidably disposed within a channel of a rail and the rail is attached to the support member, the first panel assembly and the second panel assembly are independently suspended by respective wires from the rail. Sliding the runner of the first panel assembly towards the runner of the second panel assembly translates the respective panels of the panel assemblies towards each other, thereby positioning an edge of the panel of the first panel assembly adjacent an edge of the panel of the second panel assembly for attachment, such that the second planar surface of the panel of the first planar assembly and the second planar surface of the panel of the second planar assembly at least partially define an interior surface of the ceiling.

22 Claims, 10 Drawing Sheets

(56) References Cited

U.S. PATENT DOCUMENTS

| | | | | |
|---|---|---|---|---|
| 8,096,089 | B2 * | 1/2012 | Platt | E04B 9/0414 52/316 |
| 9,194,123 | B2 | 11/2015 | Holdridge | |
| 9,328,510 | B1 | 5/2016 | Springer et al. | |
| 9,534,383 | B1 * | 1/2017 | Underkofler | E04B 9/18 |
| 9,938,717 | B2 * | 4/2018 | Gaydos | E04B 9/0435 |
| 10,011,983 | B2 | 7/2018 | Pilz et al. | |
| 10,626,605 | B2 | 4/2020 | Holdridge | |
| 11,293,178 | B2 * | 4/2022 | Bergman | E04B 9/26 |
| 11,293,608 | B2 | 4/2022 | Oleske et al. | |
| 11,479,971 | B2 | 10/2022 | Baxter et al. | |
| 2005/0211500 | A1 | 9/2005 | Wendt et al. | |
| 2006/0101764 | A1 * | 5/2006 | Jankovec | E04B 9/16 52/506.07 |
| 2008/0148665 | A1 | 6/2008 | Yonash et al. | |
| 2013/0192189 | A1 * | 8/2013 | Lawrence | D01G 15/84 19/145.5 |
| 2015/0167297 | A1 * | 6/2015 | St-Laurent | E04B 9/22 52/700 |
| 2016/0273218 | A1 * | 9/2016 | Gaydos | E04B 9/28 |
| 2018/0187415 | A1 * | 7/2018 | Dalmay | E04B 9/0414 |
| 2019/0112809 | A1 * | 4/2019 | Frantz | E04B 9/363 |
| 2020/0131765 | A1 * | 4/2020 | Rimmer | E04B 9/20 |
| 2020/0340245 | A1 * | 10/2020 | Bergman | E04B 9/26 |
| 2021/0032864 | A1 * | 2/2021 | Mayer | E04B 9/245 |
| 2022/0170602 | A1 * | 6/2022 | Oleske | E04B 9/006 |
| 2022/0186494 | A1 * | 6/2022 | Harnish | E04B 9/245 |
| 2024/0392897 | A1 * | 11/2024 | Zapsas | C04B 28/04 |

OTHER PUBLICATIONS keelmfg.com [online], "Keelgrid Color Brochure," Report #5376, available on or before May 17, 2005, via Internet Archive: Wayback Machine URL <https://web.archive.org/web/20050517012043/https://www.keelmfg.com/files/Keel_Grid_Color_Brochure.pdf>, retrieved on Sep. 4, 2024, 4 pages.

* cited by examiner

SUSPENDED CEILING SYSTEM AND METHOD

TECHNICAL FIELD

This disclosure relates to ceilings for rooms or enclosures within a building or other structure, and in particular to suspended ceiling systems.

BACKGROUND

Suspended ceilings are secondary ceilings suspended from a support member (such as a structural beam or upper ceiling). Suspended ceilings can increase the energy efficiency and aesthetics of a room, and can provide an overhead space (i.e., the space between the support member and the suspended ceiling) within which to place (for example) lighting cables or other electrical equipment, air conditioning or heating ducts, and fire prevention systems.

SUMMARY

Certain aspects of the subject matter herein can be implemented as a system for forming a ceiling suspended from a support member of a structure. The system includes a plurality of panel assemblies, a runner, and one or more wires. Each panel assembly includes a non-metallic planar panel, with each panel including a first planar surface and a second planar surface defining one or more edges. A first end of a first wire of the one or more wires is attached to the runner and a second end of the first wire of the one or more wires is attached the first planar surface. The system also includes a rail configured to be attached to the support member and including a slotted main body partially defining a channel. The system is configured such that, when a runner of a first panel assembly of the plurality of panel assemblies and a runner of a second panel assembly of the plurality of panel assemblies are each slidably disposed within the channel and the rail is attached to the support member, the first panel assembly and the second panel assembly are independently suspended by their respective wires from the rail, and sliding the runner of the first panel assembly within the channel towards the runner of the second panel assembly translates the panel of the first panel assembly towards the panel of the second panel assembly, thereby positioning a first edge of the one or more edges of the panel of the first panel assembly adjacent a first edge of the one or more edges of the panel of the second panel for attachment therewith by a connection, such that the second planar surface of the panel of the first planar assembly and the second planar surface of the panel of the second planar assembly at least partially define an interior surface of the ceiling.

Certain aspects of the subject matter herein can be implemented as a method for forming a ceiling suspended from a support member of a structure. The method includes receiving a plurality of panel assemblies, with each panel assembly including a non-metallic planar panel, a runner, and one or more wires. Each panel includes a first planar surface and a second planar surface defining one or more edges. A first end of a first wire of the one or more wires is attached to the runner and a second end of the first wire or the one or more wires is attached the first planar surface. A rail is attached to the support member, with the including a slotted main body partially defining a channel. A runner of the first panel assembly and a runner of a second panel assembly of the plurality of panel assemblies are disposed within the channel, thereby suspending the first panel assembly and the second panel assembly by their respective wires from the rail. The runner of the first panel assembly is slid within the channel towards the runner of the second panel assembly, thereby translating the panel of the first panel assembly towards the panel of the second panel assembly to position a first edge of the one or more edges of the panel of the first panel assembly adjacent a first edge of the one or more edges of the panel of the second panel. When so positioned adjacent, the first edge of the one or more edges of the panel of the first panel assembly is attached by a connection to the first edge of the one or more edges of the panel of the second panel, such that the second planar surface of the panel of the first planar assembly and the second planar surface of the panel of the second planar assembly at least partially define an interior surface of the ceiling.

The details of one or more embodiments are set forth in the accompanying drawings and the description below. Other features, objects, and advantages will be apparent from the description and drawings, and from the claims.

DETAILED DESCRIPTION

In accordance with embodiments of the present disclosure, suspended ceiling systems can include suspended panels that can be efficiently and cost-effectively installed within a variety of different structures. The panels can be made out of recycled plastic, rubber, industrial waste, construction waste, economical polymer resin or other suitable materials (including but not limited to thermoplastic or thermoset materials).

Figure 1:
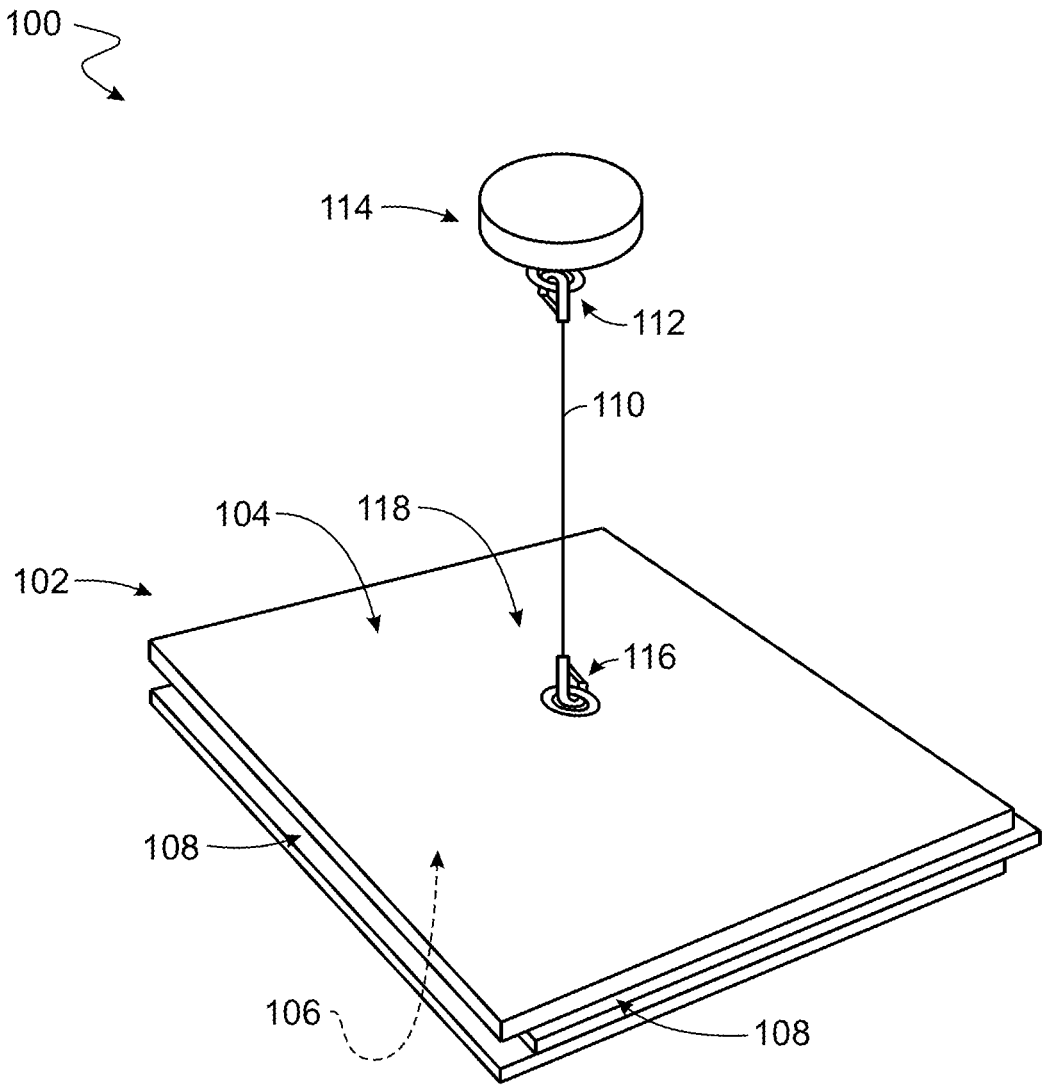
FIG. 1 is a schematic illustration of a panel assembly of a suspended ceiling system in accordance with an embodiment of the present disclosure.

FIG. 1 is a schematic illustration of a panel assembly of a suspended ceiling system in accordance with an embodiment of the present disclosure. Referring to FIG. 1, panel assembly 100 includes a planar panel 102. First planar surface 104 and second planar surface 106 (which, in the illustrated embodiment, is on the opposite side of the panel as first surface 104) define one or more edges 108. In some embodiments panels 102 can be square or rectangular in shape and can have a suitable width (for example, 30 cm, 100 cm, 1 m) and a suitable thickness (for example, 10 mm to 30 mm) to meet a to meet architectural and/or aesthetic requirements.

In some embodiments panel 102 can be a molded panel and can be comprised of, for example, recycled plastic, ground rubber, crushed electronic waste (E-waste), crumb rubber, construction waste and other waste materials like paper, card board, glass, gypsum board, crushed insulation board, excavated rock fines, fine aggregates and dune sand. In some embodiments panel 102 can be comprised of thermoplastics such as virgin or recycled ABS, PET, PVC, Nylon, PP, MDPE, or HDPE. Thermoset materials can be also used in mixes with thermoplastics or stand alone such as thermoset polyurethane, fiber-reinforced plastic (FRP), and/or composite materials. Calcium carbonate up to 30% can be added to the composition to reduce warpage in hot climates. Panel 102 can be reinforced or unreinforced as suitable for the application. In some embodiments, panel 102 is constructed with suitable materials and other characteristics so as to have properties as listed in Table 1.

TABLE 1

| Properties | Requirements |
|---|---|
| Density Kg/m3 | 60-150 Kg/m3 |
| Tensile Strength (Mpa) | 10-17 |
| Elongation at break | Greater than 5% |
| Fungus Resistance ASTM D 3273 or D 3274 | No mold or mildew growth |
| Flexural strength (Mpa) | Greater than 22 |
| Hardness (Shore D) | 30-55 |
| Surface Burning (Flame spread index)-ASTM E84 | 25 Max |
| Surface Burning (Smoke developed index) ASTM E84 | 200-450 |

In some embodiments, panel 102 may be formed via use of blowing agents to create a rigid foam with high weight reduction. In some embodiments, for fire proofing purposes, an intumescent foam or coating layer may be applied to the finished surface or applied adding hydromagnesite-huntite additive (Ultracarb) in ratios from 10 to 35% weight in combination with (or instead of) an intumescent coating. In some embodiments, panel 102 may be formed from a combination of a polymer (thermoplastic or thermoset), alumina trihydrate (ATH) and magnesium hydroxide (MH) in variable ratios up to 3% weight without an intumescent coating.

In some embodiments, panel 102 is comprised only non-metallic materials such as those described above, and does not include any metallic materials. In other embodiments, panel 102 is partially comprised of a non-metallic material and partially comprised of a metallic material. In some embodiments, panel 102 can include a laminate outer surface (such as a plastic laminate) of a suitable thickness (for example, 1 mm to 2 mm) to meet particular type of color, finish or other requirements.

Panel assembly 100 further includes at least one suspension wire 110 which in some embodiments can be 1 to 3 mm in thickness or another suitable thickness. Wire 110 can be comprised of polymeric fibers arranged together in strands or fiber yarns. The strand or yarn diameter can vary based on tensile load requirements. The materials can be virgin or recycled polymers such as PP, PE, UHMWPE, Nylon, Rayon, PVA, or PET. Other yarns combinations of such polymers or alternatives can also be used. Recycled yarns can be used by taking used fiber and that are melted and re-spun to be plied into a new yarn. Depending on the application, an alternative method includes cutting strips form recycled textiles and spinning them together to form a final yarn. Such a yarn can used as suspension wire 110 in combination with rigid foam panels and channels, provide the benefit of significant weight reduction in such systems. In some embodiments, wire 110 is constructed with suitable materials and other characteristics so as to have the properties as shown in Table 2.

TABLE 2

| Property | Values |
|---|---|
| Density (g/cm3) | 1.2-1.5 |
| Tenacity gf/tex | 15 to 70 |
| Elongation at break % | 10 to 40 |

Figure 2A:
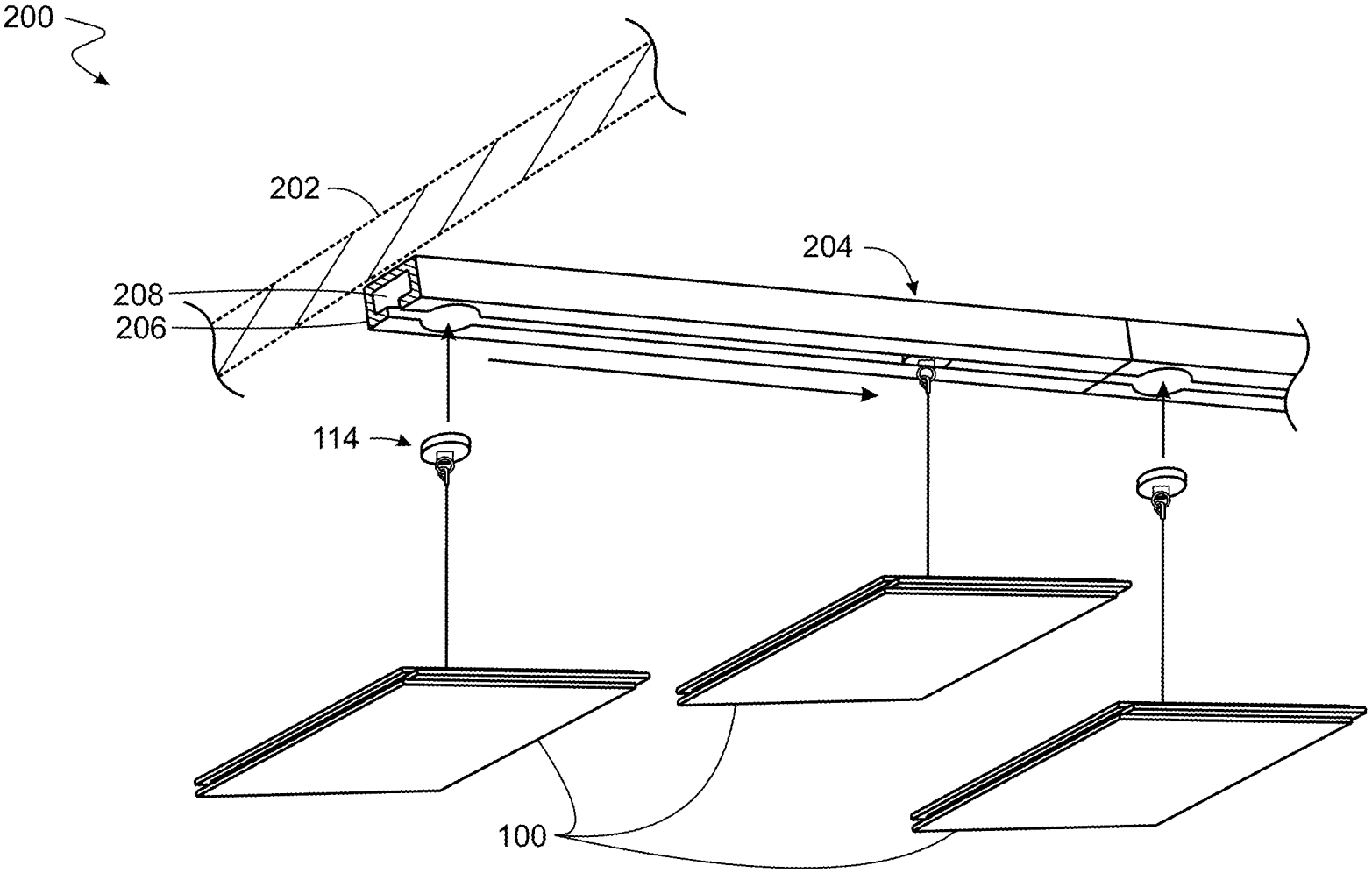
FIGS. 2A-2C are schematic illustrations of a suspended ceiling system in accordance with an embodiment of the present disclosure.
Figure 2B:
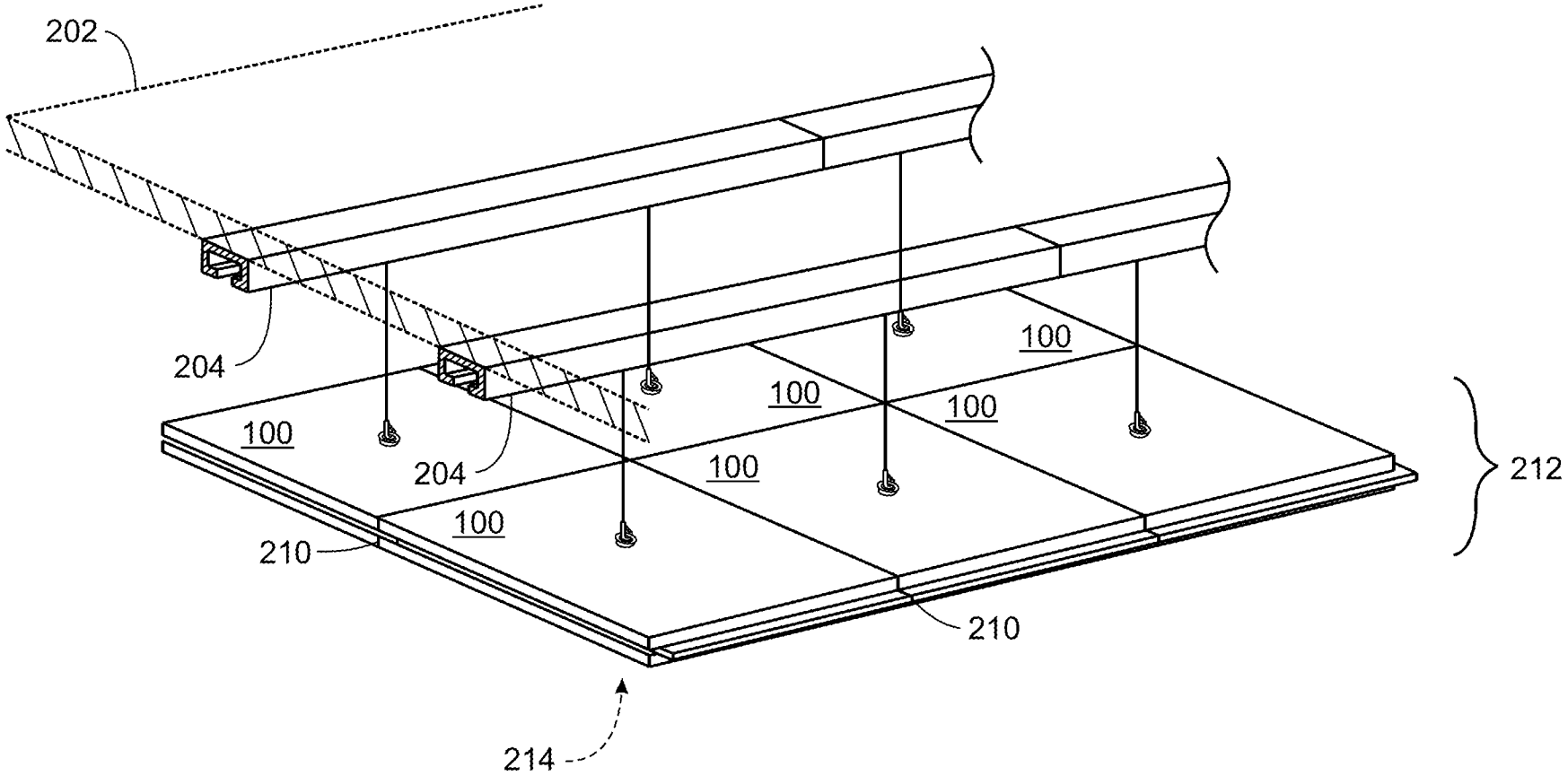
Figure 2C:
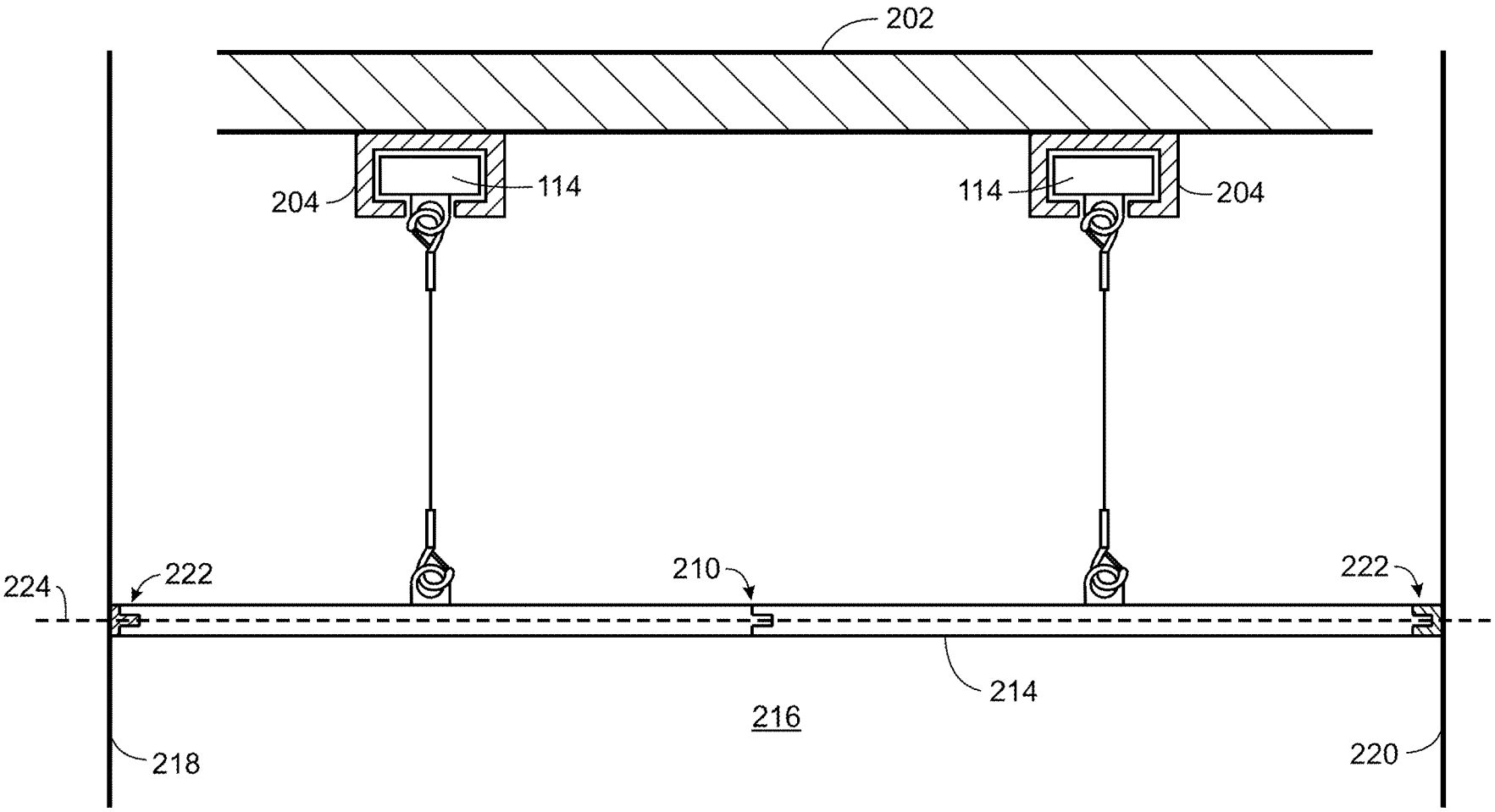

A first end 112 of wire 110 in the illustrated embodiment is attached to a runner 114. Runner 114 can in some embodiments be in the form of a circular disk and can be comprised of the same or similar materials as described above with respect to panels 102. In some embodiments, runner 114 can have another suitable shape and/or be constructed of other non-metallic or metallic materials. Runner 114 is sized and shaped so as to be disposed within a rail assembly as shown in FIGS. 2A-2C. A second end 116 of wire 110 is attached to first planar surface 104 (by, for example, a hook-and-eye connection). In some embodiments, the attachment of wire 110 to first planar surface 104 is at approximately the center point 118 of planar surface 104. In some embodiments, a panel assembly 100 can include more than one wire attached to surface 104 and each wire can be attached to separate runners (or a common runner).

FIGS. 2A-2C are schematic illustrations of a system 200 for suspending a ceiling from a support member 202 of a room (or other full or partial enclosure of a building or other structure) in accordance with an embodiment of the present disclosure. Support member 202 can be comprised of steel, cement, brick, or another suitable material and can be, for example, an overhead structural beam of a room of a building. As shown in FIG. 2A, system 200 includes a rail 204 configured attached to support member 202. Rail 204 has a slotted main body 206 partially defining a channel 208. Main body 206 and channel 208 are sized and shaped so as to receive one or more of the runners 114 of panel assemblies 100. In some embodiments, channel 208 can be 50 mm wide to 150 mm wide. Rail 204 can be comprised of the same or similar materials as described above with respect to panels 102, and in some embodiments can be 3D-printed with an additive manufacturing process. With a rail 204 attached to support member 202 and with runners 114 of panel assemblies 100 inserted into channel 208, as shown in FIG. 2A, the panel assemblies are independently suspended by their respective wires 110 from rail 204. Sliding of the runner 114 back-and-forth within the channel translates the panels 102 of panel assembly back-and-forth towards or away from each other.

As shown in FIG. 2B, a plurality of rails 204 can be attached to support member 202, at a distance and position relative to each other such that sliding of runners 114 within the rails can position edges 108 of panels 102 adjacent edges 108 of other panels 102. With the edges connected to each other by connections 210 in the adjacent position, a suspended ceiling 212 is formed, with the second planar surfaces 106 (i.e., the surfaces of the panels now facing away from rails) at least partially defining the interior surface 214 (that is, the overhead surface of the ceiling relative to occupants of the room) of the ceiling 212.

In the embodiment shown in the cross-sectional view of FIG. 2C, support member 202 is an overhead beam within a room 216 comprising walls 218 and 220, and connections 210 are direct tongue-and-groove connections of the edges of the panel assemblies (with male tongue-and-groove profiles fitting into female profiles) to create a flat, tight and secure joint. In some embodiments, the connections are of a "click-and-connect" variety that can be readily (and, in some embodiments, repeatedly) connected and disconnected without the use of tools. For example, such click-and-connect connections can in some embodiments comprise snap-fit connections. Additional connections 222 connect other edges of the panels to the walls 218 and 220. In the embodiments shown in FIGS. 2A-2B, the wire lengths are the same similar and the connection and other aspects of the configuration are such that the panels are coplanar (or substantially coplanar); that is, they reside within (or substantially within) the same horizontal plane 224.

Figure 3A:
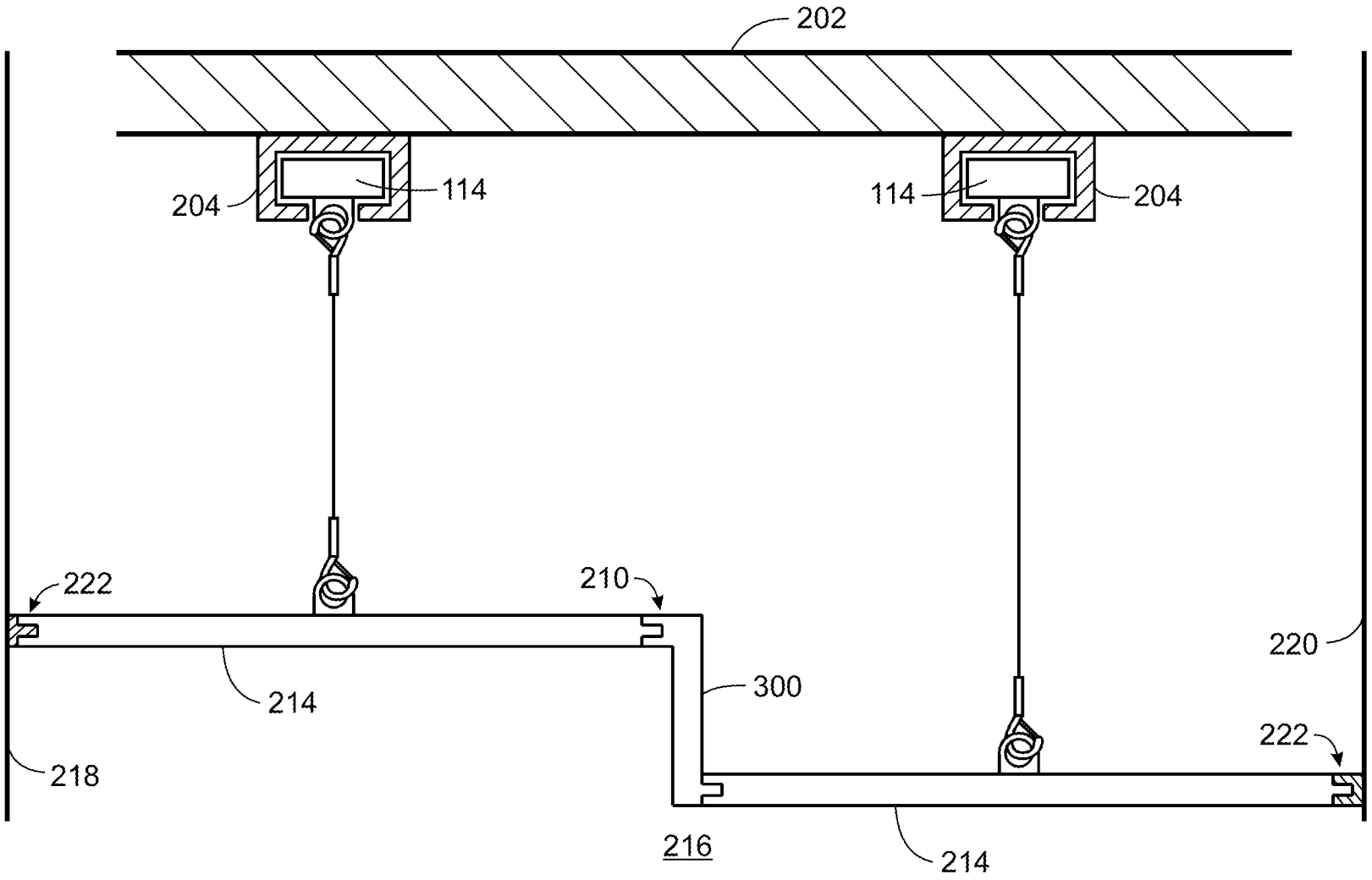
FIGS. 3A-3B are schematic illustrations of a suspended ceiling system in accordance with an embodiment of the present disclosure.
Figure 3B:
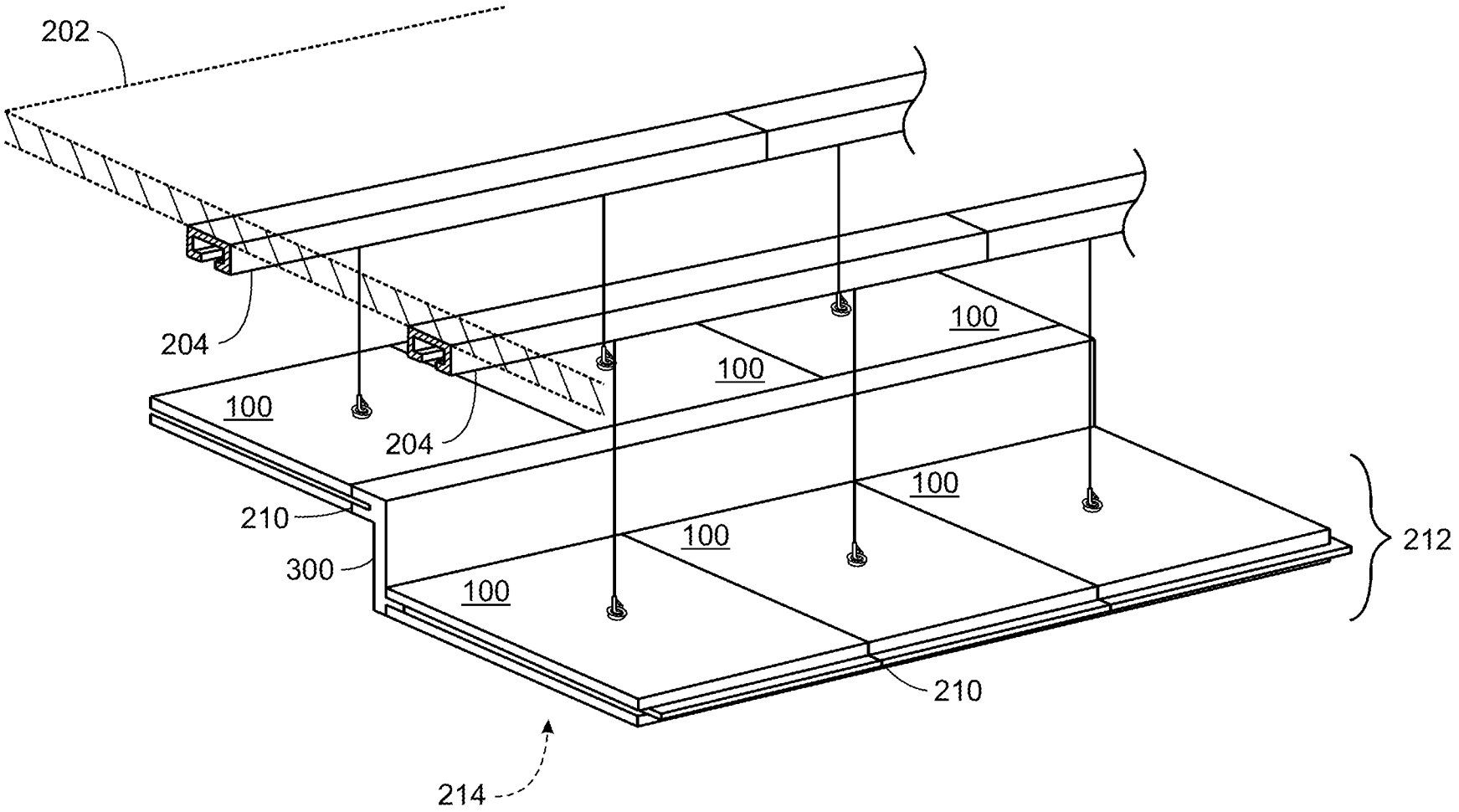

FIGS. 3A and 3B illustrate another embodiment in which at least one of the connections (shown as element 300) is a step-down connection which enables the ceiling to have panels of differing relative vertical heights within the room. Specifically, with the edges of a first set 302 of panels 102 is attached to an edge 304 of the step-down connector and edges of a second set 306 are attached to the other edge 308 of the step-down connector 300, the second planar surfaces 106 of the first set 302 of panels 102 are horizontally parallel with (or are substantially horizontally parallel with), but are vertically higher or lower relative to the rail 204 than, the planar surfaces 106 of the second set 306 of panels 102. The height of the vertical member to connect these horizontal ceiling panels to be between 50 mm to 500 mm or more as required and the depth and length of tongue and grove to be between 25 mm to 200 mm subject to the design and requirement and the length of ceiling panels.

In the embodiments shown in FIGS. 2A-2C and FIGS. 3A-3B, the panels are all horizontal or substantially horizontal. In other embodiments, the system can be configured such that some or all of the panels may be oriented other than horizontal.

Figure 4:
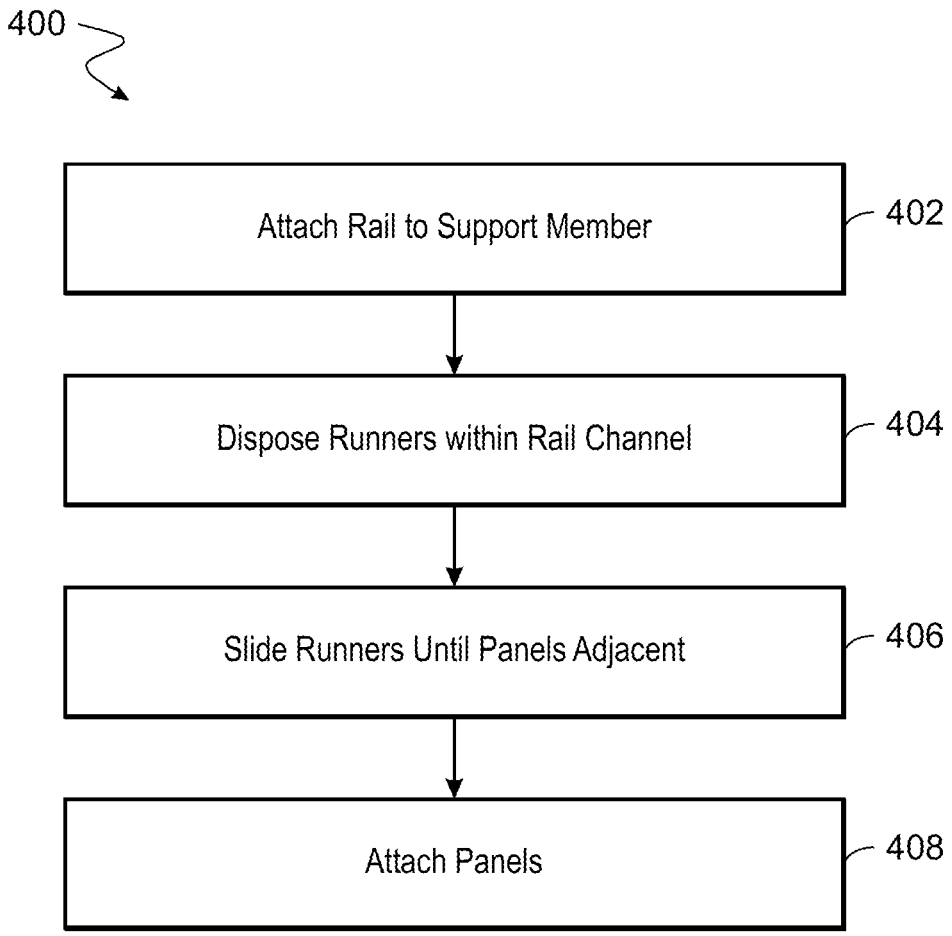
FIG. 4 a process flow diagram of a method for forming a ceiling suspended from a support member of a structure in accordance with an embodiment of the present disclosure.

FIG. 4 a process flow diagram of a method for forming a ceiling suspended from a support member of a structure in accordance with an embodiment of the present disclosure. Method 400 begins at step 402 in which a plurality of panel assemblies (such as panel assemblies 100 of FIG. 1) are received. Each panel assembly includes a non-metallic planar panel, each panel comprising a first planar surface and a second planar surface defining one or more edges, a runner, and a wire. A first end of the wire is attached to the runner and a second end of the wire is attached the first planar surface.

Method 400 then proceeds to step 402 in which a rail (such as rail 204 of FIGS. 2A-2C) is attached to the support member, the rail comprising a slotted main body partially defining a channel. Proceeding to step 404, a runner of a first panel assembly of the plurality of panel assemblies and a runner of a second panel assembly of the plurality of panel assemblies are disposed within the channel, thereby suspending the first panel assembly and the second panel assembly by their respective wires from the rail;

Proceeding to step 406, the runner of the first panel assembly within the channel is slid towards the runner of the second panel assembly, thereby translating the panel of the first panel assembly towards the panel of the second panel assembly to position a first edge of the one or more edges of the panel of the first panel assembly adjacent a first edge of the one or more edges of the panel of the second panel. At step 408, when so positioned adjacent, the first edge of the one or more edges of the panel of the first panel assembly is attached, by a connection, to the first edge of the one or more edges of the panel of the second panel, such that the second planar surface of the panel of the first planar assembly and the second planar surface of the panel of the second planar assembly at least partially define an interior surface of the ceiling.

Figure 5A:
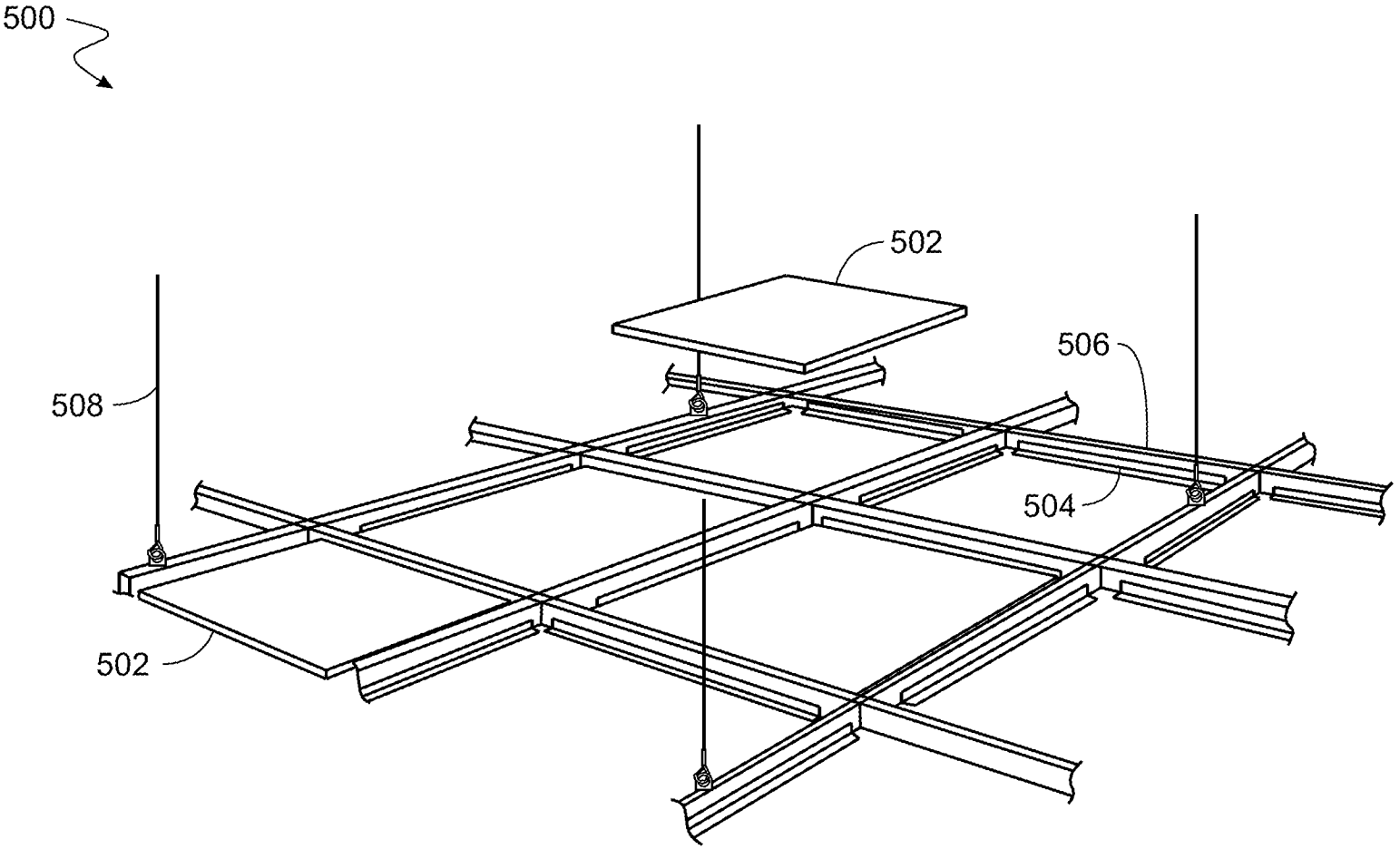
FIGS. 5A-5C are schematic diagrams of a suspended ceiling system in accordance with an embodiment of the present disclosure.
Figure 5B:
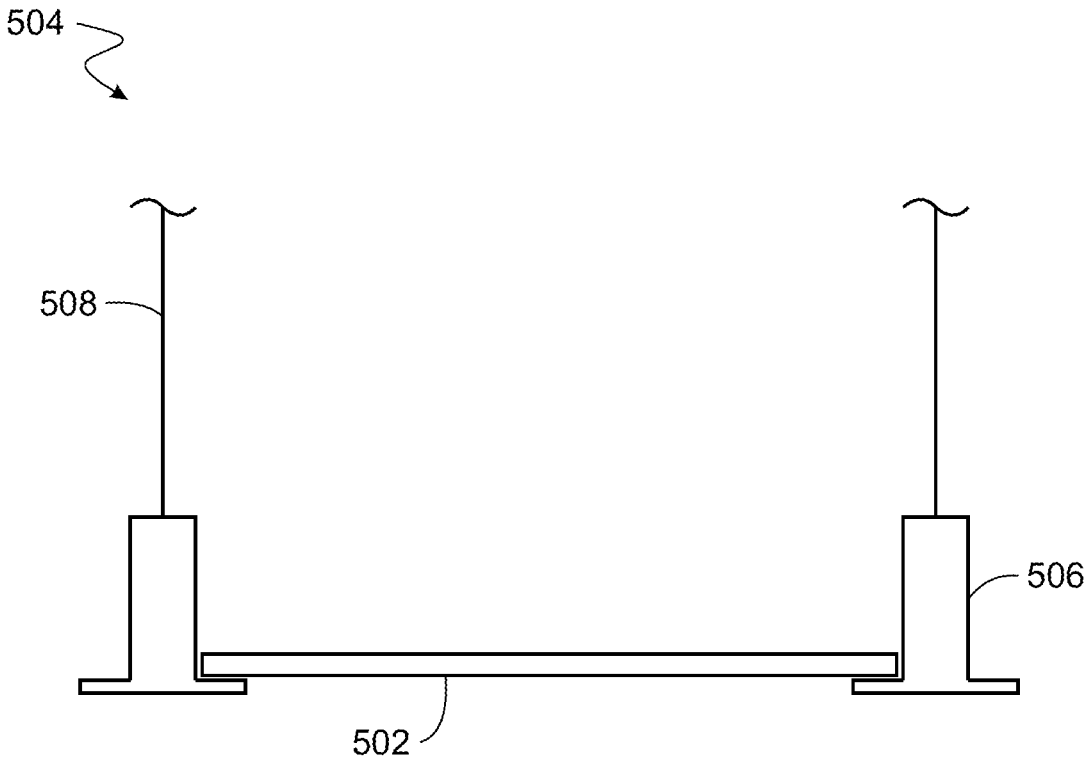
Figure 5C:
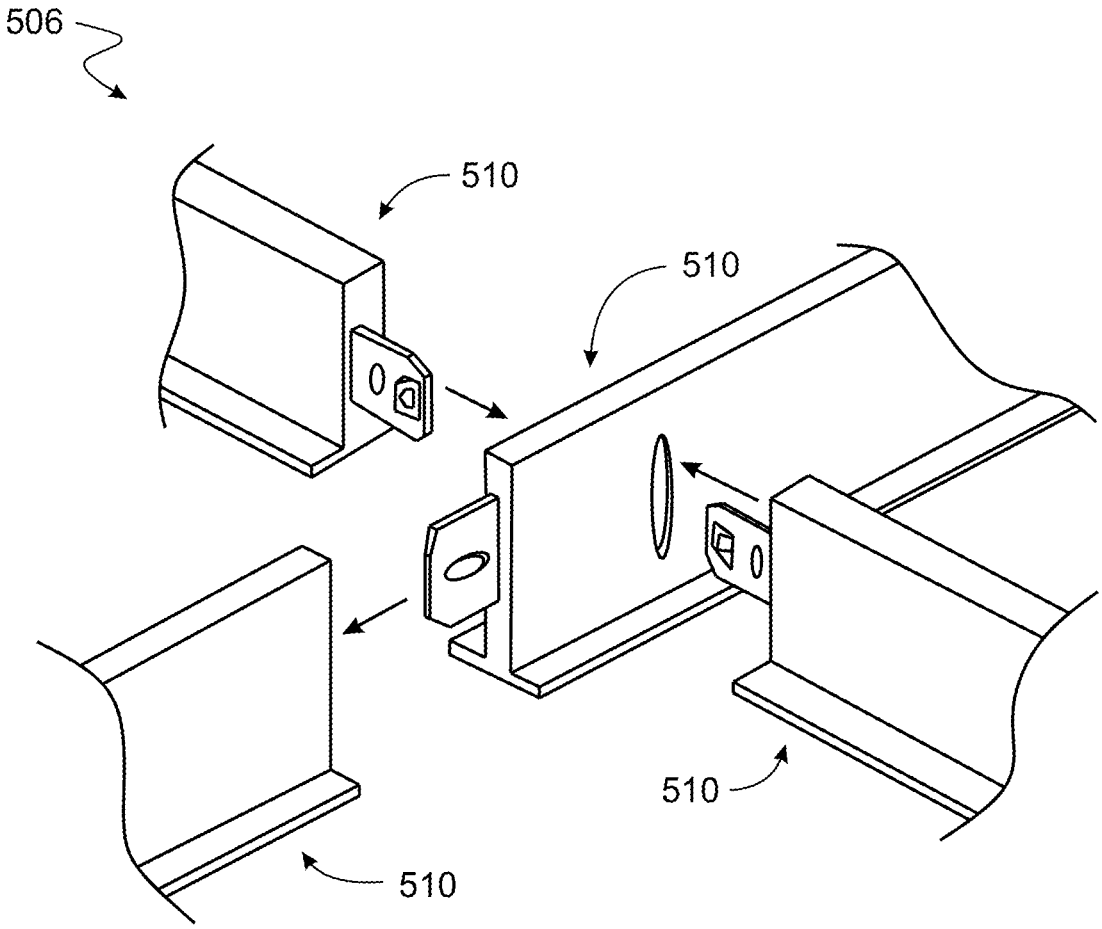

FIGS. 5A-5C are schematic illustrations of another embodiment of the present disclosure comprising a system 500 in which panels 502 are disposed within pockets 504 defined by a grid 506, as shown in FIG. 5A (and in cross-sectional view in FIG. 5B). The panels 500 can be comprised of the same or similar non-metallic materials as described above with respect to panels 102 and can have similar or the same other characteristics as described above. Grid 504 can be hung from a structural member by wires 508 comprised of the same or similar materials as described above with respect to wires 110. Panels 502 can have a width of between 40 cm and 100 cm or another suitable width to meet architectural or aesthetic requirements. As shown in FIG. 5C, grid 506 can be comprised of individual intersecting beams 510 that are t-shaped in cross-section. Beams 510 can be comprised of the same or similar non-metallic materials as described above with respect to panels 102

In this disclosure, "approximately" or "substantially" mean a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate. Accordingly, the previously described example implementations do not define or constrain the present disclosure. Other changes, substitutions, and alterations are also possible without departing from the spirit and scope of the present disclosure.

EXAMPLES

In a first aspect, a system for forming a ceiling suspended from a support member of a structure includes a plurality of panel assemblies, a runner, and one or more wires. Each panel assembly includes a non-metallic planar panel, with each panel including a first planar surface and a second planar surface defining one or more edges. A first end of a first wire of the one or more wires is attached to the runner and a second end of the first wire of the one or more wires is attached the first planar surface. The system also includes a rail configured to be attached to the support member and including a slotted main body partially defining a channel. The system is configured such that, when a runner of a first panel assembly of the plurality of panel assemblies and a runner of a second panel assembly of the plurality of panel assemblies are each slidably disposed within the channel and the rail is attached to the support member, the first panel assembly and the second panel assembly are independently suspended by their respective wires from the rail, and sliding the runner of the first panel assembly within the channel towards the runner of the second panel assembly translates the panel of the first panel assembly towards the panel of the second panel assembly, thereby positioning a first edge of the one or more edges of the panel of the first panel assembly adjacent a first edge of the one or more edges of the panel of the second panel for attachment therewith by a connection, such that the second planar surface of the panel of the first planar assembly and the second planar surface of the panel of the second planar assembly at least partially define an interior surface of the ceiling.

In a second aspect in accordance with the first aspect, the system is configured such that, when the first edge of the one or more edges of the panel of the first panel assembly is attached by the connection to the first edge of the one or more edges of the panel of the second panel, the second planar surface of the panel of the first planar assembly is coplanar with the second planar surface of the panel of the second planar assembly.

In a third aspect in accordance with the first or second aspects, the connection comprises a direct tongue-and-groove connection of the first edge of the one or more edges of the panel of the first panel assembly with the first edge of the one or more edges of the panel of the second panel assembly.

In a fourth aspect in accordance with any of the first to third aspects, the connection comprises a step-down connector and wherein the system is configured such that, when the first edge of the one or more edges of the panel of the first panel assembly is attached by the step-down connector to the first edge of the one or more edges of the panel of the second panel, the second planar surface of the panel of the first panel assembly is horizontally parallel with, and is vertically higher or lower relative to the rail than, the second planar surface of the panel of the second panel assembly.

In a fifth aspect in accordance with any of the first to fourth aspects, the connection comprises a connection readily connectible and disconnectible without the use of tools.

In a sixth aspect in accordance with any of the first to fifth aspects, the non-metallic planar panel comprises a polymer panel.

In a seventh aspect in accordance with any of the first to sixth aspects, the one ore more wires comprise non-metallic wire.

In an eighth aspect in accordance with any of the first to seventh aspects, the one or more wires comprise yarn formed from strips of recycled textiles spun together.

In a ninth aspect in accordance with any of the first to eighth aspects, the planar panel comprises rigid foam.

In a tenth aspect in accordance with any of the first to ninth aspects, the runner is non-metallic.

Certain aspects of the subject matter herein can be implemented as a method for forming a ceiling suspended from a support member of a structure. The method includes receiving a plurality of panel assemblies, with each panel assembly including a non-metallic planar panel, a runner, and one or more wires. Each panel includes a first planar surface and a second planar surface defining one or more edges. A first end of a first wire of the one or more wires is attached to the runner and a second end of the first wire or the one or more wires is attached the first planar surface. A rail is attached to the support member, with the including a slotted main body partially defining a channel. A runner of the first panel assembly and a runner of a second panel assembly of the plurality of panel assemblies are disposed within the channel, thereby suspending the first panel assembly and the second panel assembly by their respective wires from the rail. The runner of the first panel assembly is slid within the channel towards the runner of the second panel assembly, thereby translating the panel of the first panel assembly towards the panel of the second panel assembly to position a first edge of the one or more edges of the panel of the first panel assembly adjacent a first edge of the one or more edges of the panel of the second panel. When so positioned adjacent, the first edge of the one or more edges of the panel of the first panel assembly is attached by a connection to the first edge of the one or more edges of the panel of the second panel, such that the second planar surface of the panel of the first planar assembly and the second planar surface of the panel of the second planar assembly at least partially define an interior surface of the ceiling.

In a twelfth aspect in accordance with the eleventh aspect, the system is configured such that, when the first edge of the one or more edges of the panel of the first panel assembly is attached by the connection to the first edge of the one or more edges of the panel of the second panel, the second planar surface of the panel of the first planar assembly is coplanar with the second planar surface of the panel of the second planar assembly.

In a thirteenth aspect in accordance with the eleventh or twelfth aspects, the connection comprises a direct tongue-and-groove connection of the first edge of the one or more edges of the panel of the first panel assembly with the first edge of the one or more edges of the panel of the second panel assembly.

In a fourteenth aspect in accordance with any of the eleventh to thirteenth aspects, the connection comprises a step-down connector and wherein the system is configured such that, when the first edge of the one or more edges of the panel of the first panel assembly is attached by the step-down connector to the first edge of the one or more edges of the panel of the second panel, the second planar surface of the panel of the first panel assembly is horizontally parallel with, and is vertically higher or lower relative to the rail than, the second planar surface of the panel of the second panel assembly.

In a fifteenth aspect in accordance with any of the eleventh to fourteenth aspects, the connection comprises a connection readily connectible and disconnectible without the use of tools.

In a sixteenth aspect in accordance with any of the eleventh to fifteenth aspects, the non-metallic planar panel comprises a polymer panel.

In a seventeenth aspect in accordance with any of the eleventh to sixteenth aspects, the one ore more wires comprise non-metallic wire.

In an eighteenth aspect in accordance with any of the eleventh to seventeenth aspects, the one or more wires comprise yarn formed from strips of recycled textiles spun together.

In a nineteenth aspect in accordance with any of the eleventh to eighteenth aspects, the planar panel comprises rigid foam.

In a twentieth aspect in accordance with any of the eleventh to nineteenth aspects, the runner is non-metallic.

What is claimed is:

1. A system for forming a ceiling suspended from a support member of a structure, the system comprising:

a plurality of panel assemblies, each panel assembly comprising:

a non-metallic planar panel, each panel comprising a first planar surface and a second planar surface defining one or more edges;

a runner; and one or more wires attached to the runner and to approximately a center point of the first planar surface; and a rail configured to be attached to the support member and comprising a slotted main body partially defining a channel, wherein the system is configured such that, when a runner of a first panel assembly of the plurality of panel assemblies and a runner of a second panel assembly of the plurality of panel assemblies are each slidably disposed within the channel and the rail is attached to the support member:

the panel of the first panel assembly and the panel of the second panel assembly are independently suspended at approximately their respective center points by respective wires from the rail; and sliding the runner of the first panel assembly within the channel towards the runner of the second panel assembly translates the panel of the first panel assembly towards the panel of the second panel assembly, thereby positioning a first edge of the one or more edges of the panel of the first panel assembly adjacent a first edge of the one or more edges of the panel of the second panel assembly for attachment therewith by a connection, such that the second planar surface of the panel of the first planar assembly and the second planar surface of the panel of the second planar assembly at least partially define an interior surface of the ceiling and the second planar surface of the panel of the first panel assembly is coplanar with the second planar surface of the panel of the second planar assembly.

2. The system of claim 1, wherein the connection comprises a direct tongue-and-groove connection of the first edge of the one or more edges of the panel of the first panel assembly with the first edge of the one or more edges of the panel of the second panel assembly.

3. The system of claim 1, wherein connection comprises a step-down connector and wherein the system is configured such that, when (a) the first edge of the one or more edges of the panel of the first panel assembly is attached to a first edge of the step-down connector and (b) the first edge of the one or more edges of the panel of the second panel is attached to a second edge of the step-down connector, the second planar surface of the panel of the first panel assembly is horizontally parallel with, and is vertically higher or lower relative to the rail than, the second planar surface of the panel of the second panel assembly.

4. The system of claim 3, wherein the attachment by the step-down connector of the first edge of the one or more edges of the panel of the first panel assembly to the first edge of the one or more edges of the panel of the second panel assembly is by a snap-fit connection.

5. The system of claim 1, wherein the connection comprises a connection readily connectible and disconnectible without the use of tools.

6. The system of claim 1, wherein the non-metallic planar panel comprises a polymer panel.

7. The system of claim 1, wherein the one ore more wires comprise non-metallic wire.

8. The system of claim 1, wherein the one or more wires comprise yarn formed from strips of recycled textiles spun together.

9. The system of claim 1, wherein the planar panel comprises rigid foam.

10. The system of claim 1, wherein the runner is non-metallic.

11. The system of claim 1, wherein the attachment by the connection is by a snap-fit connection.

12. A method for forming a ceiling suspended from a support member of a structure, the method comprising:

receiving a plurality of panel assemblies, each panel assembly comprising:

a non-metallic planar panel, each panel comprising a first planar surface and a second planar surface defining one or more edges;

a runner; and one or more wires attached to the runner and to approximately a center point of the first planar surface;

attaching a rail to the support member, the rail comprising a slotted main body partially defining a channel;

disposing a runner of a first panel assembly of the plurality of panel assemblies and a runner of a second panel assembly of the plurality of panel assemblies within the channel, thereby independently suspending the panel of the first panel assembly and the panel of the second panel assembly at approximately their respective center points by their respective wires from the rail;

sliding the runner of the first panel assembly within the channel towards the runner of the second panel assembly and thereby translating the panel of the first panel assembly towards the panel of the second panel assembly to position a first edge of the one or more edges of the panel of the first panel assembly adjacent a first edge of the one or more edges of the panel of the second panel assembly; and when so positioned adjacent, attaching, by a connection, the first edge of the one or more edges of the panel of the first panel assembly to the first edge of the one or more edges of the panel of the second panel, such that the second planar surface of the panel of the first planar assembly and the second planar surface of the panel of the second planar assembly at least partially define an interior surface of the ceiling and the second planar surface of the panel of the first panel assembly is coplanar with the second planar surface of the panel of the second planar assembly.

13. The method of claim 12, wherein the connection comprises a direct tongue-and-groove connection of the first edge of the one or more edges of the panel of the first panel assembly with the first edge of the one or more edges of the panel of the second panel assembly.

14. The method of claim 12, wherein the connection comprises a step-down connector and wherein the system is configured such that, when (a) the first edge of the one or more edges of the panel of the first panel assembly is attached to a first edge of the step-down connector and (b) the first edge of the one or more edges of the panel of the second panel is attached to a second edge of the step-down connector, the second planar surface of the panel of the first panel assembly is horizontally parallel with, and is vertically higher or lower relative to the rail than, the second planar surface of the panel of the second panel assembly.

15. The method of claim 14, wherein the attachment by the step-down connector of the first edge of the one or more edges of the panel of the first panel assembly to the first edge of the one or more edges of the panel of the second panel assembly is by a snap-fit connection.

16. The method of claim 12, wherein the connection comprises a connection readily connectible and disconnectible without the use of tools.

17. The method of claim 12, wherein the non-metallic planar panel comprises a polymer.

18. The method of claim 12, wherein the one or more wires comprise non-metallic wire.

19. The method of claim 12, wherein the one or more wires comprise yarn formed from strips of recycled textiles spun together.

20. The method of claim 12, wherein the planar panel comprises rigid foam.

21. The method of claim 12, wherein the runner is non-metallic.

22. The method of claim 12, wherein the attachment by the connection is by a snap-fit connection.

* * * * *